US007063071B2

(12) United States Patent
Raichle et al.

(10) Patent No.: US 7,063,071 B2
(45) Date of Patent: Jun. 20, 2006

(54) METHOD AND DEVICE FOR CONTROLLING AN INTERNAL COMBUSTION ENGINE

(75) Inventors: Franz Raichle, Korntal-Muenchingen (DE); Jens Damitz, Illingen (DE); Wolfram Gerwing, Hessigheim (DE); Ruediger Fehrmann, Leonberg (DE); Wolfgang Fischer, Gerlingen (DE); Matthias Schueler, Steinheim (DE); Michael Kessler, Leonberg-Warmbronn (DE); Tobias Kress, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/029,446

(22) Filed: Jan. 4, 2005

(65) Prior Publication Data

US 2005/0145219 A1 Jul. 7, 2005

(30) Foreign Application Priority Data

Jan. 7, 2004 (DE) ..... 10 2004 001 120
Jul. 8, 2004 (DE) ..... 10 2004 033 072

(51) Int. Cl.
*F02M 7/00* (2006.01)

(52) U.S. Cl. ..... 123/435; 123/299

(58) Field of Classification Search ..... 123/435, 123/299, 300, 295, 305, 436, 478
See application file for complete search history.

(56) References Cited

U.S. PATENT DOCUMENTS

| | | | | |
|---|---|---|---|---|
| 4,896,642 | A * | 1/1990 | Washino et al. | 123/406.42 |
| 5,403,245 | A * | 4/1995 | Watanabe et al. | 477/54 |
| 6,272,426 | B1 * | 8/2001 | Tascillo | 701/106 |
| 6,276,319 | B1 * | 8/2001 | Walter et al. | 123/90.15 |
| 6,516,781 | B1 * | 2/2003 | Weisman | 123/435 |
| 6,553,958 | B1 * | 4/2003 | Kolmanovsky et al. | 123/295 |
| 6,560,526 | B1 * | 5/2003 | Matekunas et al. | 701/104 |
| 6,619,255 | B1 * | 9/2003 | Urushihara et al. | 123/295 |
| 6,820,592 | B1 * | 11/2004 | Buck et al. | 123/435 |

FOREIGN PATENT DOCUMENTS

DE 101 59 017 6/2003

* cited by examiner

*Primary Examiner*—Mahmoud Gimie
(74) *Attorney, Agent, or Firm*—Kenyon & Kenyon LLP

(57) ABSTRACT

A device and a method for controlling an internal combustion engine, where a first variable characterizing the pressure in the combustion chamber of at least one cylinder of the internal combustion engine is measured by at least one sensor. A second variable characterizing the energy released during the combustion is ascertained from the first variable. When a threshold value of the second variable is exceeded, a third variable characterizing the combustion process is detected.

8 Claims, 3 Drawing Sheets

METHOD AND DEVICE FOR CONTROLLING AN INTERNAL COMBUSTION ENGINE

BACKGROUND INFORMATION

German Patent No. DE 101 59 017 describes a method and a device for controlling an internal combustion engine, where at least one sensor is provided for measuring a first variable, which characterizes the pressure in the combustion chamber of at least one cylinder. A second variable, which characterizes the combustion process in the corresponding combustion chamber, is ascertained from this first variable. In this context, the change in the first variable and/or a variable that characterizes the combustion characteristic is essentially ascertained.

SUMMARY OF THE INVENTION

In the case of diesel engines, the injection into a combustion chamber is divided up into several partial injections. This yields a higher degree of freedom in the optimization of the target variables of fuel consumption, emission, and comfort. In addition, further partial injections after the main injection are necessary for implementing exhaust-gas treatment systems, the particle filters, and NOx storage catalytic converters. In order to attain exact fuel metering, in particular in the partial injections, special measures are necessary. The procedure according to the present invention allows markedly improved fuel metering to be attained.

An important variable influencing the combustion is the start of combustion with respect to the position of the crankshaft. In order to allow this variable to be controlled in a precise manner, the time at which the combustion begins should be known as exactly as possible. According to the present invention, a second variable characterizing the heat-release characteristic is ascertained from a measured variable that characterizes the pressure in the combustion chamber of at least one cylinder. When a threshold value of the second variable is exceeded, a third variable characterizing the combustion process is detected.

According to the present invention, the combustion process is detected by analyzing particular signals, such as those of the combustion-chamber pressure, the structure-borne noise sensor, or other suitable sensors. A second variable, which characterizes the energy released during combustion, in particular the released heat, is preferably used as a variable for monitoring the combustion process. The heat-release characteristic, the combustion characteristic, the cumulative heat-release characteristic, and/or the cumulative combustion characteristic have proven to be advantageous as a suitable second variable. In particular, the start of combustion, the center point of conversion, and the end of combustion are regarded as the third variable characterizing the combustion process.

Defined as the third variable characterizing the combustion process is the time, or the angular position of the crankshaft or the camshaft, at which the heat-release characteristic, the combustion characteristic, the cumulative heat-release characteristic, and/or the cumulative combustion characteristic exceeds a threshold value. Alternatively, or in addition, the spacing of the times or the angular positions may be used as a variable characterizing the combustion process. It is particularly advantageous, when a conversion rate is determined from the difference of two third variables. The conversion rate, which characterizes the rate of combustion, is ascertained from two times or two angular positions, at which specific threshold values are exceeded.

A percentage of a maximum value of the heat-release characteristic, the combustion characteristic, the cumulative heat-release characteristic, and/or the cumulative combustion characteristic is advantageously selected as a threshold value for the corresponding combustion. The advantage of this is that precise detection is also possible when the signal is subjected to large fluctuations. This is particularly the case with combustion-chamber pressure and/or structure-borne noise. This signal is subjected to very sharp fluctuations. The relative valuation of the signal or the relative selection of the threshold value with respect to the maximum yields a more reliable evaluation.

DETAILED DESCRIPTION

Figure 1:
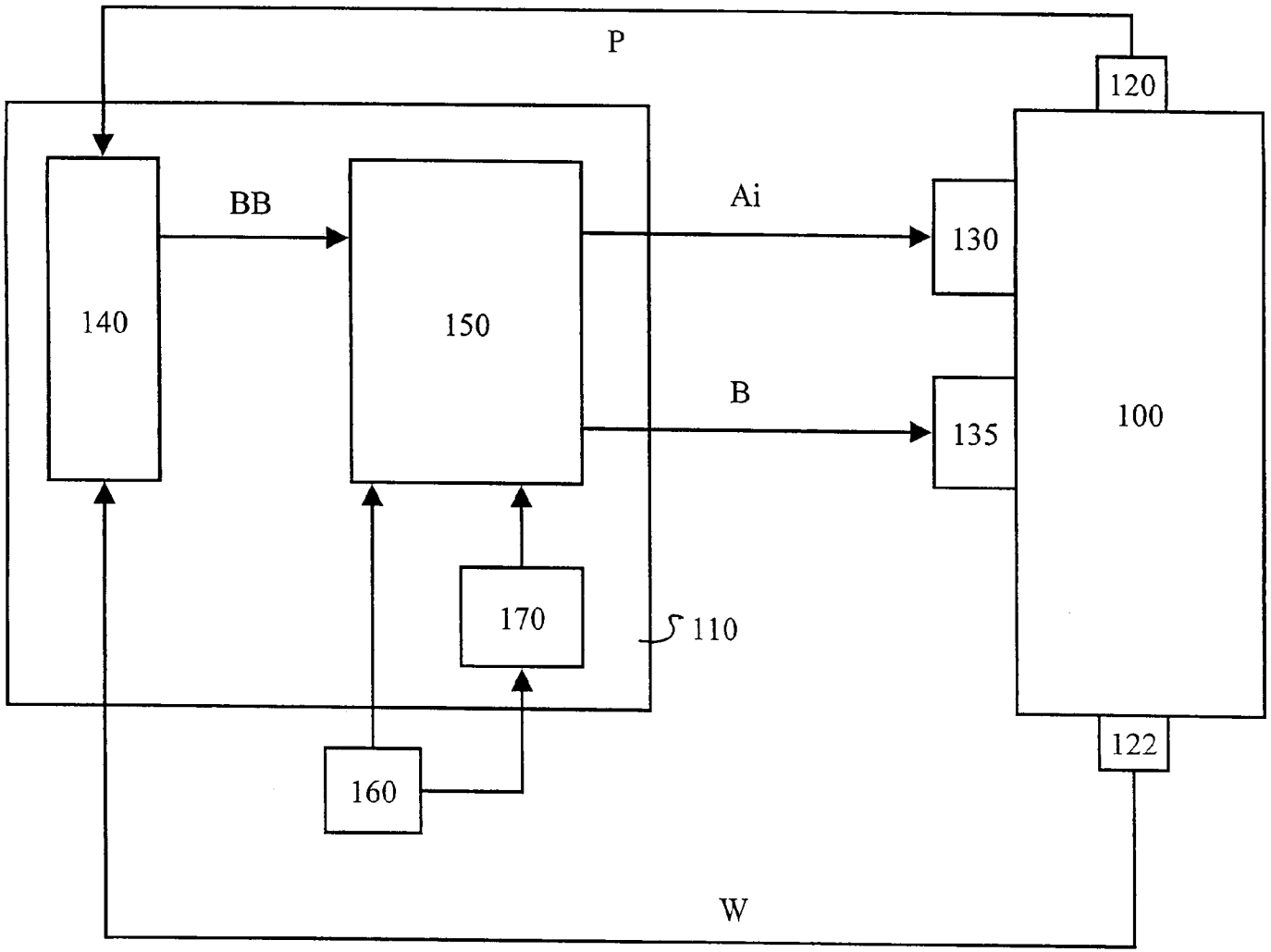
FIG. 1 shows a block diagram of a device for implementing the method of the present invention.

The procedure according to the present invention is represented in FIG. 1 with the aid of a block diagram. An internal combustion engine is denoted by 100. First of all, at least one pressure sensor 120 and one angular-position sensor 122 are positioned at the internal combustion engine. Pressure sensor 20 supplies a signal P, which characterizes the pressure in at least one combustion chamber of the internal combustion engine. A first embodiment provides only one pressure sensor, which is positioned at a representative cylinder and characterizes the pressure in the cylinder. In a second embodiment, a pressure sensor is positioned at each cylinder of the internal combustion engine; in each instance, the pressure sensor generating a signal characterizing the pressure in the combustion chamber of the respective cylinder.

Angular-position sensor 122 is preferably positioned at the crankshaft of the engine and supplies a high-resolution, angle signal W regarding the angular position of the crankshaft. As an alternative, the angular-position sensor may also be situated at the camshaft of the engine.

In addition, a first actuator 130 and a second actuator 135 are positioned at the internal combustion engine. The actuators and the sensors are connected to a control unit 110.

Signal P of pressure sensor 120 and signal W of angular-position sensor 122 are transmitted to an evaluation unit 140, which preferably forms a module of control unit 110. Evaluation unit 140 transmits a signal BB to a functional unit 150. In turn, first actuator 130 receives a first control variable Ai from the functional unit, and second actuator 135 receives a second control variable B from the functional unit. First control variable Ai is preferably a cylinder-specific control variable, which may be individually specified for each cylinder. Second control variable B is a global engine control variable for triggering actuator 135, which controls a global variable.

Control variables Ai are preferably the control times and/or the starts of the control of an injection. It is preferable for an injection event of the working cycle to be divided up into a plurality of partial injections. In this context, control variable Ai is the control time and/or the start of control of at least one of the partial injections. Usually, at least one main injection, at least one pre-injection, and at least one post-injection are provided as partial injections. The procedure of the present invention is particularly advantageous for the main injection and the pre-injection. In addition to, or as an alternative to, the control time and/or the start of control, the injection-rate curve of the partial injections may also be specified. This is the curve of the injection amount versus time or angular unit.

In particular, the supercharging pressure and/or the control variables influencing the amount of air supplied to the internal combustion engine, such as the exhaust-gas recirculation rate and/or the injection pressure and/or the rail pressure, are used as global engine control variables.

Furthermore, functional unit 150 receives the output signals of a further functional unit 170, which, like functional unit 150, processes the output signals of further sensors 160, which may also be situated in the region of the internal combustion engine. Further functional unit 170 may be, for example, a control unit for controlling the exhaust-gas recirculation or one of the above-mentioned global control variables.

Preferably, the cylinder-pressure characteristics of all cylinders Pi are individually acquired by combustion-chamber pressure sensors. As an alternative, only one cylinder treated as representative may be provided with a pressure-detection means. In both cases, a high-resolution angle signal W is used as a reference variable.

The sensor signals of pressure P and angle W are supplied to evaluation unit 140, which is typically a component of the engine control unit. Its task is to generate characteristic variables BB, which are also referred to below as characteristics and are preferably transmitted to a control system as an actual variable (quantity), and/or which are limited to allowable values by comparing them to one or more threshold values.

Heat-release characteristic DQ indicates the energy transmitted by the combustion to the working gas as a function of the crank angle. The unit of the heat-release characteristic is normally [J/° CA] or corresponding conversions. The combustion characteristic represents an analogous variable. However, in contrast to the heat-release characteristic, the combustion characteristic includes the entire heat released during combustion. Therefore, the combustion characteristic is, in essence, greater than the heat-release characteristic by the amount of heat flowing through the combustion-chamber walls per unit angle.

Using the first law of thermodynamics, the heat-release characteristic and/or the combustion characteristic are calculated from the cylinder-pressure characteristic with the aid of certain model assumptions, when caloric data about the combustion gas and fuel and data about the engine geometry are known.

According to the above-mentioned definitions of the heat-release characteristic, cumulative heat-release characteristic Q represents the integral of the curve of heat-release development DQ with respect to the crank angle. The cumulative combustion characteristic corresponds to the integral of the combustion characteristic with respect to the crank angle.

Figures 2, 2A, 2B, 2C:
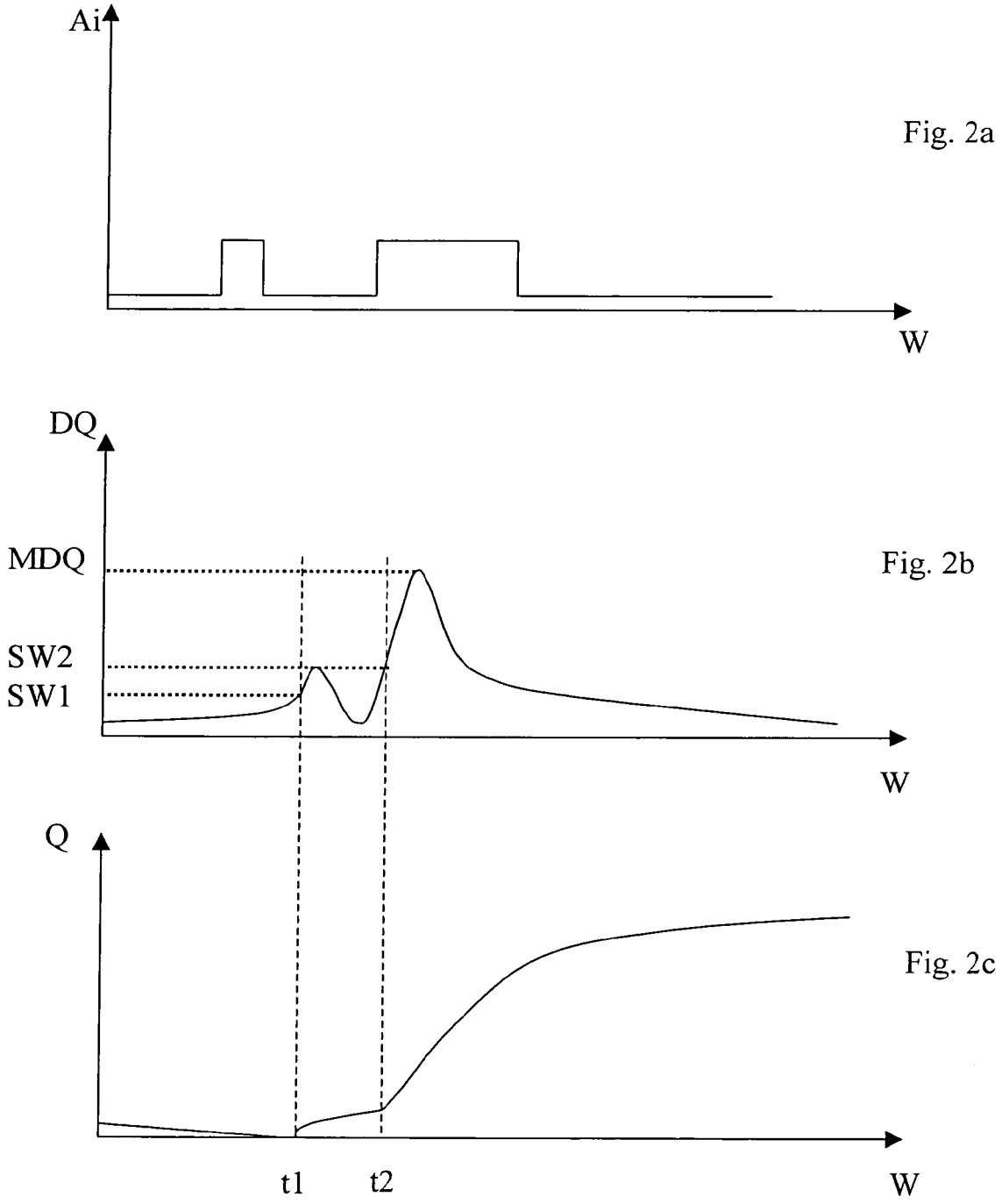
FIGS. 2*a*–2*c* show various signals plotted versus time.

In FIGS. 2*a*–2*c*, different signals are plotted versus time. In FIG. 2*a*, control signal AI for a cylinder and an injection event is plotted versus angular position W of the crankshaft. In FIG. 2*b*, heat-release development DQ is plotted versus angular position W, and in FIG. 2*c*, cumulative heat-release characteristic Q is also plotted versus angular position W of the crankshaft.

A pre-injection and a main injection are shown in the represented, specific embodiment. Signal DQ characterizing the heat-release characteristic increases after the pre-injection and exceeds a specific threshold value SW1 at time t1. After a further increase, the signal decreases again. After the main injection occurs, the signal likewise increases again and exceeds a second threshold value SW2 at time t2. The signal reaches maximum value MDQ after some time and subsequently decreases again.

Initially, cumulative heat-release characteristic Q slowly decreases prior to the injection. It then increases with the pre-injection at time t1 and increases again at time T2.

According to the present invention, time t2, at which heat-release characteristic DQ exceeds threshold value SW2, is referred to as the start of combustion of the main injection. Time t1, at which heat-release characteristic DQ exceeds first threshold value SW1, is referred to as the start of combustion of the pre-injection.

In this context, it is particularly advantageous that the threshold value is selected as a value relative to maximum value MDQ of the main injection. The threshold value for the pre-injection is likewise selected in relation to the maximum value of the pre-injection.

The heat-release characteristic reflects the combustion characteristic, the first increase being caused by the combustion of the pre-injection. The second increase is caused by the combustion of the main injection. The procedure of the present invention ascertains maxima MDQ of the heat-release characteristic and generates a threshold value, which corresponds to a percentage of the maxima. The angular position or the time of the threshold value in the heat-release characteristic with regard to a reference point is defined as the start of combustion. Top dead center of the corresponding cylinder is usually used as a reference point. The threshold value is preferably situated so that the start of the increases in the cumulative heat-release characteristic caused by the combustion correspond to this time. This is the case when the threshold value corresponds to approximately 50% of respective maximum value MDQ. In a first specific embodiment, maximum value MDQ is used for the start of combustion of the pre-injection. In a second specific embodiment, the maximum value attained during the pre-injection is used.

Figure 3:
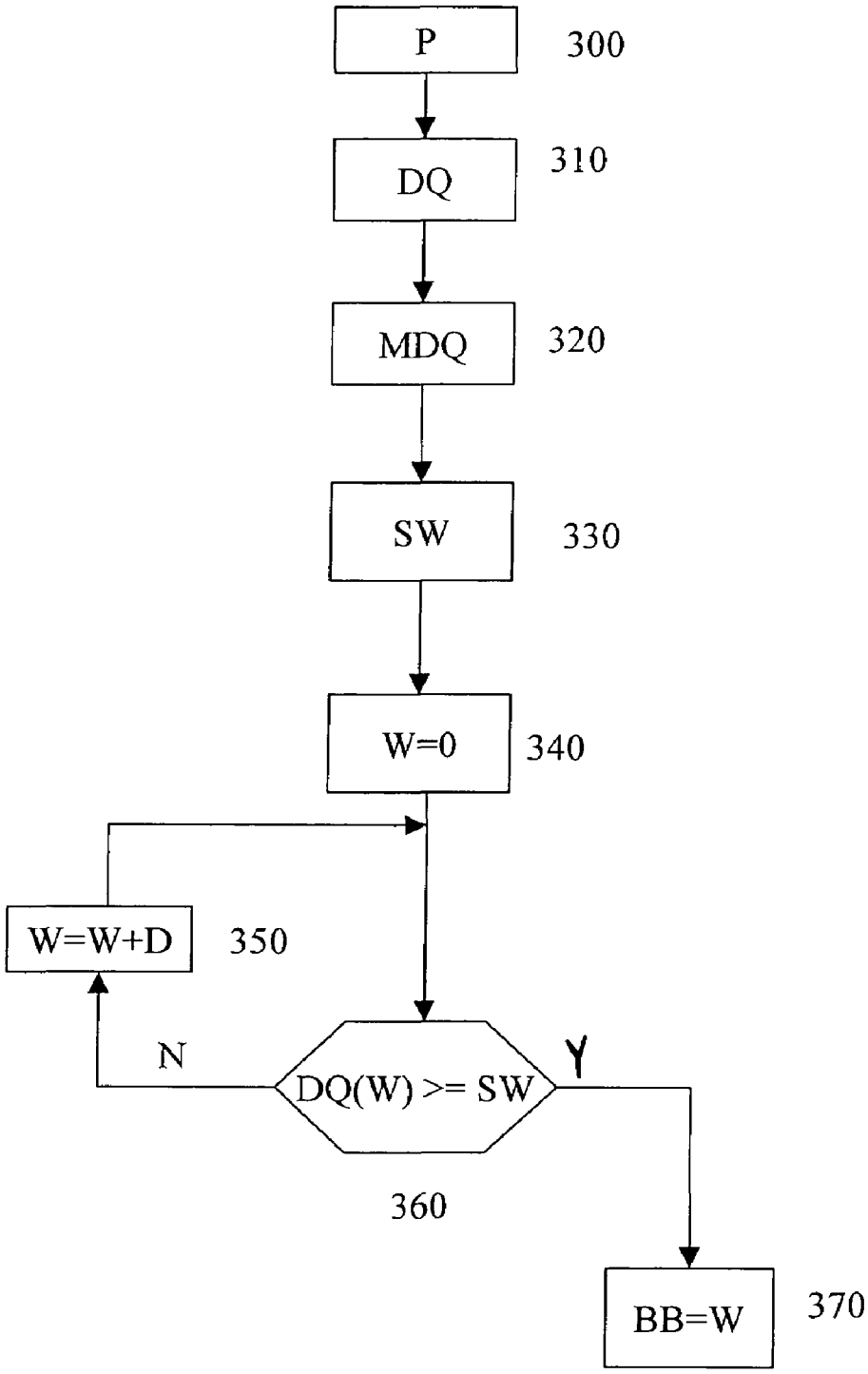
FIG. 3 shows a flow chart of the procedure according to the present invention.

FIG. 3 shows a possible specific embodiment of the procedure according to the present invention, using a flow chart. In a first step 300, a first variable characterizing the pressure in the combustion chamber of at least one cylinder of the internal combustion engine is detected by at least one sensor. This is preferably a sensor for detecting the combustion-chamber pressure. As an alternative, a structure-borne sensor generating a structure-borne noise signal may also be used. In subsequent step 310, heat-release characteristic DQ is calculated from the measured variable. In the following step, the value of the heat-release characteristic is determined at its maxima. This maximum value MDQ is determined, in each instance, for all of the partial injections or the considered partial injections. This is accomplished, for example, by differentiating the signal and ascertaining the angular position at which the differentiated signal assumes a value of 0. At this angular position or time, the value of the heat-release characteristic is then ascertained and used as maximum value MDQ.

In subsequent step 330, threshold value SW is ascertained. This is preferably achieved by using a specific percentage or fraction of maximum value MDQ as a threshold value. In following step 340, an angular counter W is set to 0. Subsequent interrogation 360 checks if the heat-release characteristic at angular position W is greater than or equal to threshold value SW. If this is not the case, angular counter W is advanced by an increment D in step 350, and step 360 is carried out again. If this is the case or if the value of heat-release development DQ at angular position W is equal to the threshold value, then, in step 370, the angular value is stored as the value of start of combustion BB.

It is preferably provided that the heat-release development be plotted versus the angular position for the entire combustion, that maximum value MDQ be ascertained, and that start of combustion BB then be determined with the aid of the described method or another method, in which it is checked if the corresponding threshold value is exceeded. As an alternative, it may also be provided that the threshold value be calculated and used for determining the start of combustion according to method steps 340 through 360 during the next injection into the same cylinder or into a subsequent cylinder.

As an alternative to the angular position, a time variable may also be used.

In a further refinement of the procedure according to the present invention, the cumulative heat-release characteristic or the cumulative combustion characteristic may be evaluated in place of the heat-release characteristic or the combustion characteristic. In these specific embodiments, relative conversion points, such as those that can be ascertained, for example, from the cumulative heat-release characteristic and/or the cumulative combustion characteristic, are used. Both the cumulative heat-release characteristic and the cumulative combustion characteristic may be obtained from the cylinder-pressure curve and/or from the structure-borne noise signal.

In a first step, a so-called reference conversion is ascertained. This is preferably the limit value of the cumulative heat-release characteristic or the cumulative combustion characteristic. In a first exemplary embodiment, all of the combustion is taken into consideration. An advantageous embodiment provides for the conversion of an instance of partial combustion to be used as a reference conversion. In this case, the corresponding variables of the individual instances of partial combustion may be ascertained. That is, it is provided that the partial conversion only be determined from an instance of partial combustion, e.g. only from the main combustion, and/or that the total conversion of all instances of combustion be determined and used as a reference conversion.

The threshold values that correspond to particular percentages of the reference conversion are then selected on the basis of this reference conversion. That is, with the aid of the percentage-based partial conversion, the angular position with respect to top dead center of the piston, at which this fraction of the total conversion has been released by the combustion, is determined for each cylinder. This angular position is adjusted to a setpoint angular position, using cylinder-specific actions of a control system on the injection time, the injection amount, and/or other variables.

It has proven to be particularly advantageous when angular position AQ03, at which 3% of the reference conversion is attained, or angular position AQ05, at which 5% of the reference conversion is attained, is used as a characteristic of the start of combustion or partial combustion. Angular position AQ30, at which 30% of the reference conversion is attained, is used as characteristic of the earlier phase of combustion. Angular position AQ50, at which 50% of the reference conversion is attained, is preferably used for describing the center point of conversion. The center point of conversion has a considerable influence on the nitrogen-oxide emissions and the fuel consumption. In this manner, the nitrogen-oxide emissions may be markedly reduced, when this center point of conversion, i.e. angular position AQ50, is adjusted to suitable setpoint values. As an alternative, the setpoint selection may be adjusted to an effective compromise between fuel consumption and emissions. Angular position AQ80, at which 80% of the reference conversion is reached, is used as the end of combustion. This characteristic characterizes, in particular, the effect of the combustion on the exhaust gas temperature.

According to the present invention, at least one, several, or all of these variables are adjusted to suitable setpoint values.

It is particularly advantageous when combined characteristics are used as a setpoint value for the control. A particularly advantageous feature is the so-called conversion rate, which is determined from the difference of two conversion points, i.e. the space between reaching a first angular position and a second angular position is determined and supplied to a control system as an actual value. The separation is preferably calculated as an angular difference or a time difference.

It is particularly advantageous when the difference between angular position AQ80 and AQ50 is determined. This variable essentially traces the combustion rate in the late combustion phase. This may be controlled, in turn, by actions on the exhaust-gas recirculation amount, the injection position, i.e. the start of injection, and/or the supercharging pressure in the form of a controlled variable. The conversion rate between angular position AQ80 and AQ05 yields an average conversion rate of the entire combustion.

The difference of angular positions AQ30 and AQ5 is advantageously used for determining the conversion rate in an early phase of the combustion. Accordingly, the conversion towards the end of the combustion is preferably ascertained, using the difference of angular positions AQ80 and AQ50.

The procedure of determining conversion-percentage points from the heat-release characteristic or combustion characteristic or from the cumulative heat-release characteristic or the cumulative combustion curve and using them for control has the advantage, that these directly measure the physical effect of the combustion and may be adjusted. This means that the combustion process may be physically monitored in a quantitative manner. Application data for the setpoint values of the control systems may be physically interpreted and easily applied to other engines.

The characteristics ascertained in this manner, such as start of combustion BB, are preferably supplied as an actual value to a control system, which adjusts these to a desired setpoint value when suitable control variables are selected. In this context, the setpoint value is selected as a function of various operating parameters.

In addition, or as an alternative, it may also be provided that the start of combustion be used for separating different injections. Thus, times at which an injection or incidence of combustion begins may be ascertained. At this time, a variable characterizing the injected amount of fuel is then calculated from a combustion-chamber pressure signal. This calculation ends at the beginning of the next partial injection. This calculation is preferably performed by taking the difference of two values, which were calculated at the start of combustion of two partial injections.

What is claimed is:

1. A method for controlling an internal combustion engine, the method comprising:

measuring a first variable characterizing a pressure in a combustion chamber of at least one cylinder of the internal combustion engine by at least one sensor;

ascertaining a second variable characterizing an energy released during a combustion from the first variable; and detecting a third variable characterizing a combustion process in response to a threshold value of the second variable being exceeded, the third variable corresponding to one of a time and an angular position of one of a crankshaft and a camshaft at which one of a start of combustion, a center of conversion, and an end of combustion occurs.

2. The method according to claim 1, wherein the second variable includes at least one of a heat-release characteristic and a combustion characteristic.

3. The method according to claim 1, wherein the second variable includes at least one of a cumulative heat-release characteristic and a cumulative combustion characteristic.

4. The method according to claim 1, wherein the threshold value is a function of a maximum value of the second variable.

5. The method according to claim 1, further comprising determining a conversion rate from a difference of two third variables.

6. The method according to claim 1, further comprising supplying the third variable to a control system as an actual value.

7. The method according to claim 1, further comprising using the third variable for separating different injections.

8. A device for controlling an internal combustion engine, comprising:

at least one sensor for measuring a first variable characterizing a pressure in a combustion chamber of at least one cylinder of the internal combustion engine;

means for ascertaining, from the first variable, a second variable characterizing an energy released during a combustion; and means for detecting a third variable characterizing a combustion process in response to a threshold value of the second variable being exceeded, the third variable corresponding to one of a time and an angular position of one of a crankshaft and a camshaft at which one of a start of combustion, a center of conversion, and an end of combustion occurs.

* * * * *

UNITED STATES PATENT AND TRADEMARK OFFICE

CERTIFICATE OF CORRECTION

PATENT NO. : 7,063,071 B2
APPLICATION NO. : 11/029446
DATED : June 20, 2006
INVENTOR(S) : Raichle Franz et al.

It is certified that error appears in the above-identified patent and that said Letters Patent is hereby corrected as shown below:

On the Title Page, Item (57) ABSTRACT, line 2, change "engine, where" to --engine are described, where--

Column 1, line 6 Add the following: --The present invention relates to a method and a device for controlling an internal combustion engine according to the preambles of the independent claims.--

Column 1, line 7 change "German Patent No. DE 101 59 017 describes" to --DE 101 59 017 describes--

Column 1, line 8 change "combustion engine, where" to --combustion, where--

Column 3, line 34 change "actual variable (quantity), and/or" to --actual variable [quantity], and or--

Column 3, line 61 change "In FIGS. 2a-2c, different" to --In FIG. 2, different--

Signed and Sealed this

Thirtieth Day of October, 2007

JON W. DUDAS
*Director of the United States Patent and Trademark Office*